US006652388B1

(12) United States Patent
Lenhof et al.

(10) Patent No.: US 6,652,388 B1
(45) Date of Patent: Nov. 25, 2003

(54) METHOD AND APPARATUS FOR ASSEMBLING A SHAFT TO A GOLF CLUB HEAD AND A GOLF CLUB HAVING SUCH ASSEMBLY

(75) Inventors: Konrad Lenhof, Vista, CA (US); Jerry V. Blanke, Murrieta, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/248,571

(22) Filed: Jan. 29, 2003

(51) Int. Cl.[7] ..... A63B 53/02
(52) U.S. Cl. ..... 473/306; 473/309
(58) Field of Search ..... 473/308, 309, 473/310, 311, 306, 307, 305

(56) References Cited

U.S. PATENT DOCUMENTS

| | | | | |
|---|---|---|---|---|
| 4,679,791 A | | 7/1987 | Hull | |
| 4,869,304 A | | 9/1989 | Gore | |
| 5,197,733 A | | 3/1993 | Schroder | |
| 5,240,252 A | | 8/1993 | Schmidt et al. | |
| 5,275,399 A | | 1/1994 | Schmidt et al. | |
| 5,326,099 A | | 7/1994 | Yamamoto et al. | |
| 5,362,048 A | | 11/1994 | Haste | |
| 5,741,394 A | | 4/1998 | Kennedy | |
| 5,771,552 A | | 6/1998 | Karner et al. | |
| 5,931,742 A | | 8/1999 | Nishimura et al. | |
| 5,951,411 A | * | 9/1999 | Wood et al. | 473/307 |
| 5,972,144 A | | 10/1999 | Hsu | |
| 6,039,659 A | | 3/2000 | Hamm | |
| 6,050,903 A | | 4/2000 | Lake | |
| 6,089,991 A | | 7/2000 | Yeh | |
| 6,120,384 A | | 9/2000 | Drake | |
| 6,146,286 A | | 11/2000 | Masuda | |

* cited by examiner

*Primary Examiner*—Stephen Blau
(74) *Attorney, Agent, or Firm*—Michael A. Catania; Elaine H. Lo

(57) ABSTRACT

A method and apparatus for assembling a shaft to a golf club head is disclosed. The club head is positioned in a club head alignment device of the apparatus, which further includes a holding device and a press device with a jaw mechanism. A ferrule and a sleeve are placed on the tip end of the shaft, and the butt end is inserted into the holding device. The tip end of the shaft and the sleeve are inserted into a tapered bore in the hosel of the club head. The jaw mechanism of the press device is then enclosed around the shaft, and the press device is operated to force the sleeve further into the tapered hosel bore. The club head and partially attached shaft are then removed from the apparatus, and the ferrule is secured to the hosel to completely attach the shaft.

9 Claims, 14 Drawing Sheets

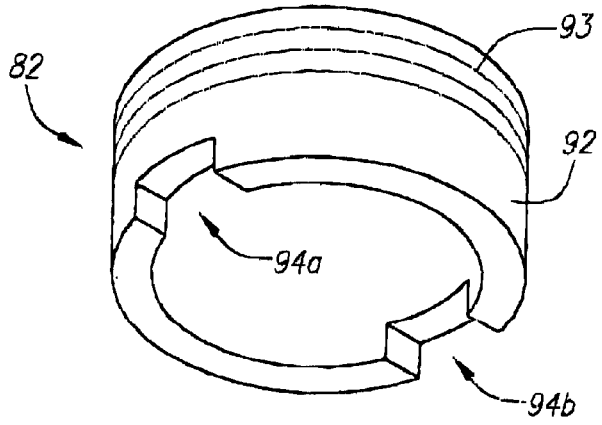
FIG. 11
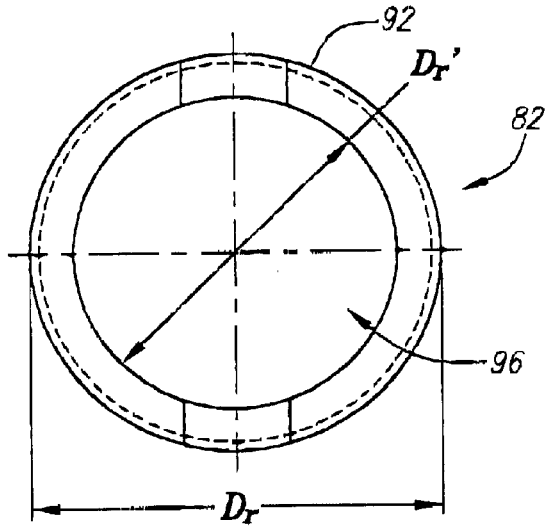
FIG. 12
FIG. 13
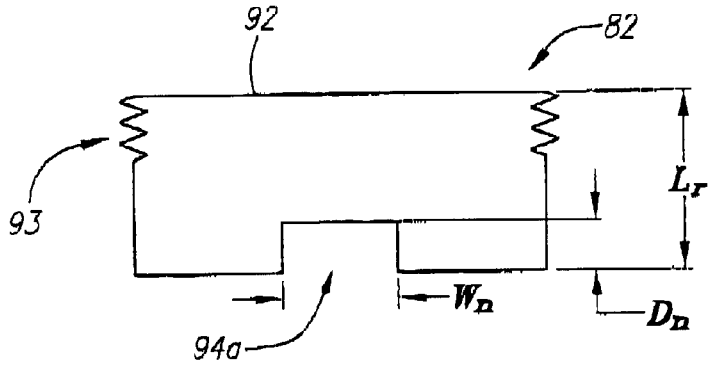

METHOD AND APPARATUS FOR ASSEMBLING A SHAFT TO A GOLF CLUB HEAD AND A GOLF CLUB HAVING SUCH ASSEMBLY

CROSS REFERENCE TO RELATED APPLICATIONS

Not Applicable

FEDERAL RESEARCH STATEMENT

Not Applicable

BACKGROUND OF INVENTION

1. Field of the Invention

The present invention relates to assembling shafts to golf club heads. More specifically, the present invention relates to a method and apparatus for assembling and securing a shaft to a golf club head.

2. Description of the Related Art

The game of golf has benefited greatly from technological advancements throughout its glorious history. Examples include the progression of golf balls from a leather featherie version to the gutta percha version to the dimpled version to the two-piece and three-piece versions of today. Another example of the technological advancement of golf is the progression of the shaft from wood to metal to graphite to the hybrid versions of today. Yet another example of the technological advancement of golf is the progression of woods from persimmon to steel to titanium to the advanced materials of today. All of these advancements have greatly improved the game of golf for golfers everywhere. However, the game of golf is still requires a golf club with a shaft connected to a golf club head in order to strike a golf ball.

The attachment of the shaft to the golf club head requires securing the shaft to the golf club head in a manner that withstands the tremendous forces exerted during swinging and impact with a golf ball. The attachment mechanism could encompass compressive forces, chemical adhesion and/or mechanical means. One preferred manner for attaching a shaft to a metal wood has been the use of an epoxy to secure the shaft within a hosel. This attachment procedure is usually performed manually, with an operator overcoating a tip end of a shaft with epoxy, and then inserting the shaft into the hosel wherein excess epoxy (2 to 4 grams) is flushed onto the golf club head. In a through-bore golf club head, the tip end of the shaft extends through the bore in the sole of the golf club head and is cut during the assembly process. This attachment procedure is wasteful (excess shaft material and epoxy) and detrimental to the operator if performed continuously throughout the day. The current procedure also requires the step of sand blasting the hosel to create a better adhesive surface for the epoxy. Further, such an attachment procedure typically requires heating the golf club in an oven for two hours to cure the epoxy and completely secure the shaft to the golf club head. Such ovens require great amounts of floor space in a factory, and use excessive amounts of energy. In addition, the epoxy may not be evenly dispersed between the shaft and the hosel, leaving voids which would adversely affect the bond between the shaft and the golf club head. Thus, there is a need for an improvement in the attachment of a shaft to a golf club head.

SUMMARY OF INVENTION

The present invention provides a solution to the wastefulness and other problems of attaching a shaft to a golf club head. The present invention is able to accomplish this by providing a method and apparatus that eliminates the need for an adhesive or epoxy to secure a shaft to a golf club head, which reduces production time while simplifying the procedure for an operator.

One aspect of the present invention is an apparatus for assembling a shaft to a golf club head. The golf club head has a hosel with a tapered bore. The shaft has a tip end and a butt end. A sleeve and a ferrule are disposed on the shaft. The apparatus includes an upper section and a lower section, a club head alignment device, a holding device, and a press device including a jaw mechanism. The club head alignment device is disposed on the lower section of the frame and receives the golf club head. The holding device receives the butt end of the shaft and is disposed on the upper section of the frame. The holding device is also capable of vertical oscillation. The press device is disposed on the lower section of the frame and is capable of vertical oscillation. The press device has a cavity for receiving the shaft with the ferrule disposed thereon. The jaw mechanism of the press device is capable of enclosing the shaft above the sleeve and forcing the sleeve into the tapered hosel bore of the golf club head during oscillation of the press device.

Another aspect of the present invention is a method for assembling a shaft to a golf club head. The golf club head has a hosel with a tapered bore. The shaft has a tip end and a butt end. The method begins with positioning the golf club head in a club head alignment device of an assembly apparatus. Next, a ferrule and a sleeve are placed on the shaft proximate the tip end. The butt end of the shaft is then positioned into a holding device of the assembly apparatus. Next, a portion of the tip end of the shaft and a portion of the sleeve are placed into the tapered bore of the hosel of the golf club head. A jaw mechanism of the press device then encloses around a portion of the shaft between the sleeve and the ferrule. Next, the press device moves to engage a top end of the sleeve and force the sleeve into the tapered bore of the hosel of the golf club head to create a golf club head with partially attached shaft. When the press device moves away from the golf club head, the jaw mechanism disengages. Next, the golf club head with the partially attached shaft is removed from the assembly apparatus. Finally, the ferrule is secured to the hosel to create a golf club head with a completely attached shaft.

Still another aspect of the present invention is a golf club including a golf club head and a shaft. The golf club head may be a wood-type or an iron-type golf club head. The golf club head includes a hosel having a tapered bore. A tip end of the shaft with a tapered sleeve disposed thereon is inserted into the tapered bore of the hosel. The golf club further includes a ferrule secured to the hosel to retain the sleeve and shaft in place.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF DRAWINGS

FIG. 11 is an isolated perspective view of a retention nut.

FIG. 12 is a bottom plan view of the retention nut of FIG. 11.

FIG. 13 is a side view of the retention nut of FIG. 11.

DETAILED DESCRIPTION

Figures 1, 1A:
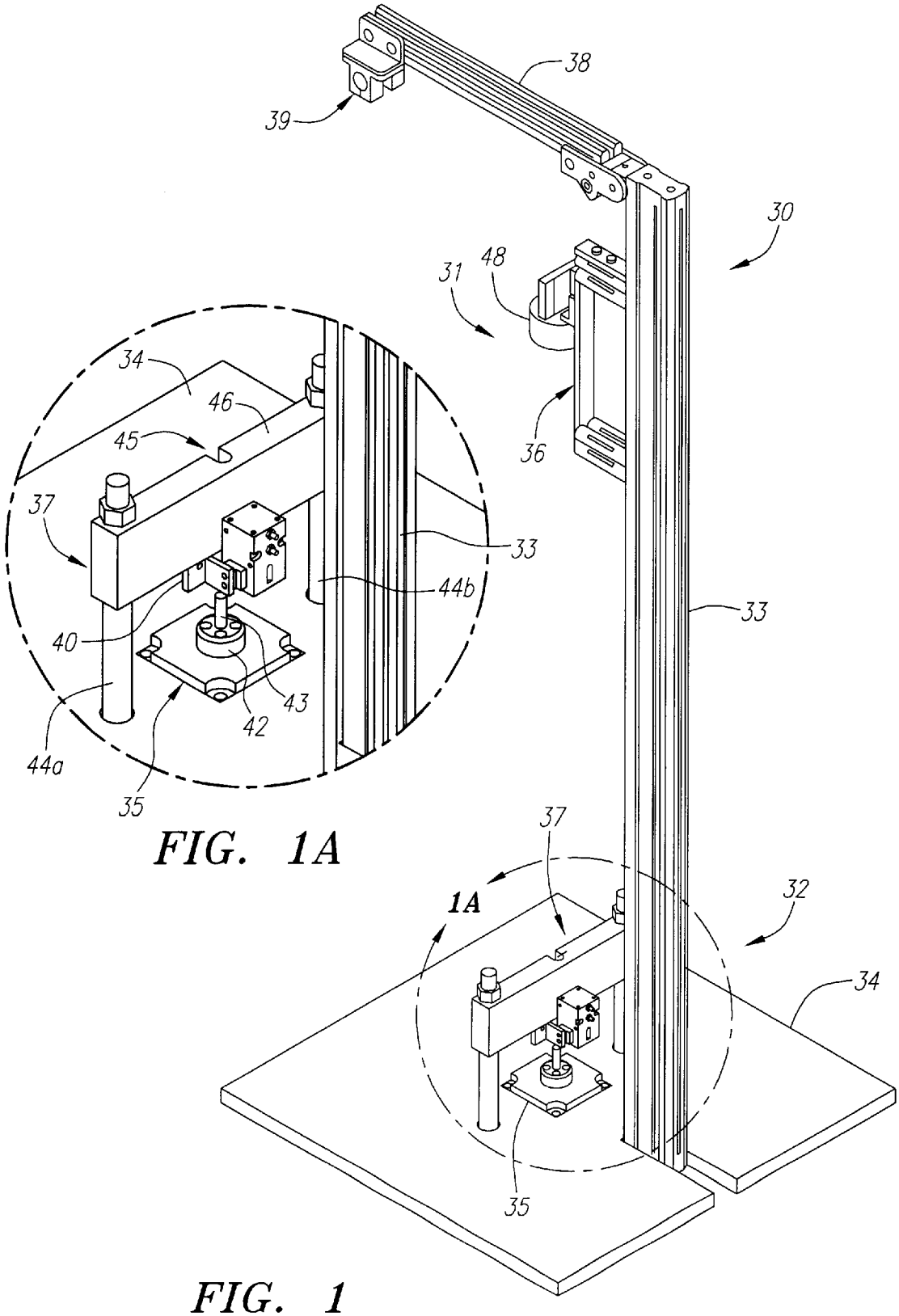
FIG. 1 is a side perspective view of a preferred embodiment of the apparatus.
FIG. 1A is an enlarged view of circle A of FIG. 1.
Figures 2, 2A:
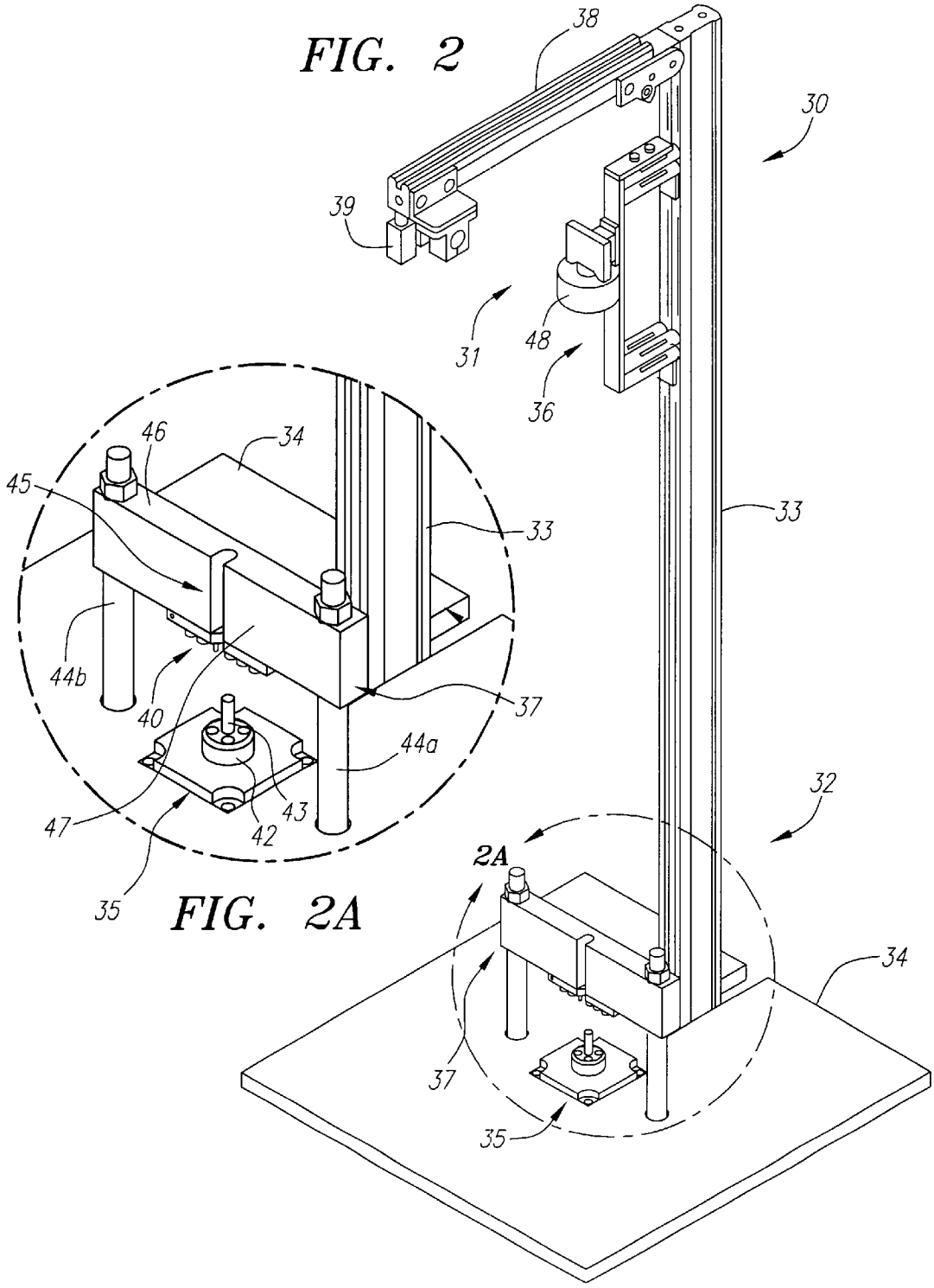
FIG. 2 is a front perspective view of the apparatus of FIG. 1.
FIG. 2A is an enlarged view of circle A of FIG. 2.

As shown in FIGS. 1, 1A, 2 and 2A, an assembly apparatus is generally designated 30. The apparatus 30 preferably has an upper section 31 and a lower section 32. The apparatus 30 preferably has an elongated bar 33 connected to a base 34. The elongated bar 33 will generally have a length corresponding to the length of a shaft, which varies depending on the golf club (generally 30 to 52 inches). The apparatus 30 is preferably composed of a metal material, such as aluminum.

The apparatus 30 is constructed for the attachment of a shaft to a golf club head without the use of an epoxy or other adhesive to secure the shaft to the hosel of the golf club head. The apparatus 30 preferably includes a club head alignment device 35 for positioning a club head in the apparatus 30 for attachment of a shaft thereto. The apparatus 30 also preferably includes a holding device 36 disposed in the upper section 31 of the apparatus 30. The holding device 36, which is movable in a vertical direction with respect to the club head alignment device 35, retains the shaft during the attachment process. The apparatus 30 also preferably includes a press device 37 disposed in the lower section 32 of the apparatus 30. The press device 37 assists in attaching the shaft to the golf club head through use of a jaw mechanism 40, which has first and second jaws 41*a* and 41*b*. The press device 37 preferably includes an open cavity 45 in a main member 46, which is connected to the base 34 by a pair of stanchions 44*a* and 44*b*. The cavity 45, which is preferably approximately 4 inches in length, is open on a front surface 47 of the main member 46. The main member 46 preferably oscillates in a vertical direction within a set a range (preferably 0.5 inch to 3 inches) along the stanchions 44*a* and 44*b*.

The holding device 36 preferably includes a retaining member 48 with an aperture (not shown) for receiving the shaft. The retaining member 48 holds the shaft during operation of the press device 37 as discussed below.

The club head alignment device 35 has a projection base 42 with a projection 43 thereon for retaining and aligning the golf club head within the apparatus 30. Those skilled in the pertinent art will recognize that other means may be used for aligning the golf club head within the apparatus 30 without departing from the scope and spirit of the present invention.

The apparatus 30 also preferably includes a lateral arm 38 connected to the elongated bar 33. The lateral arm 38 has a shaft alignment device 39 for aligning the shaft graphics with the face of the golf club head. The shaft alignment device 39 is preferably a laser alignment device, such as a Mini Laser Line 1049 with Industrial Housing available from H-W Fairway International, Inc. of Kent, Ohio.

Figure 5:
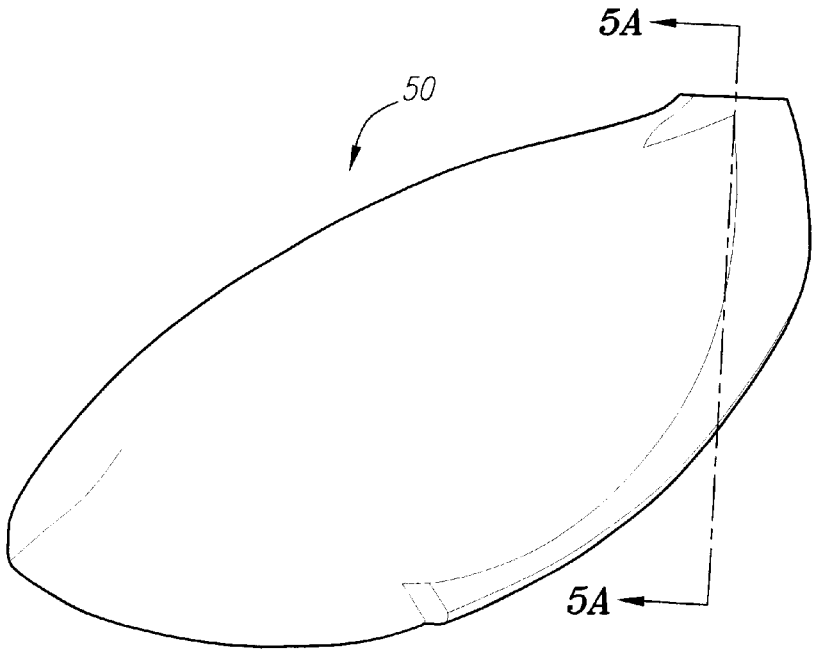
FIG. 5 is an isolated view of a wood-type golf club head.
Figure 5A:
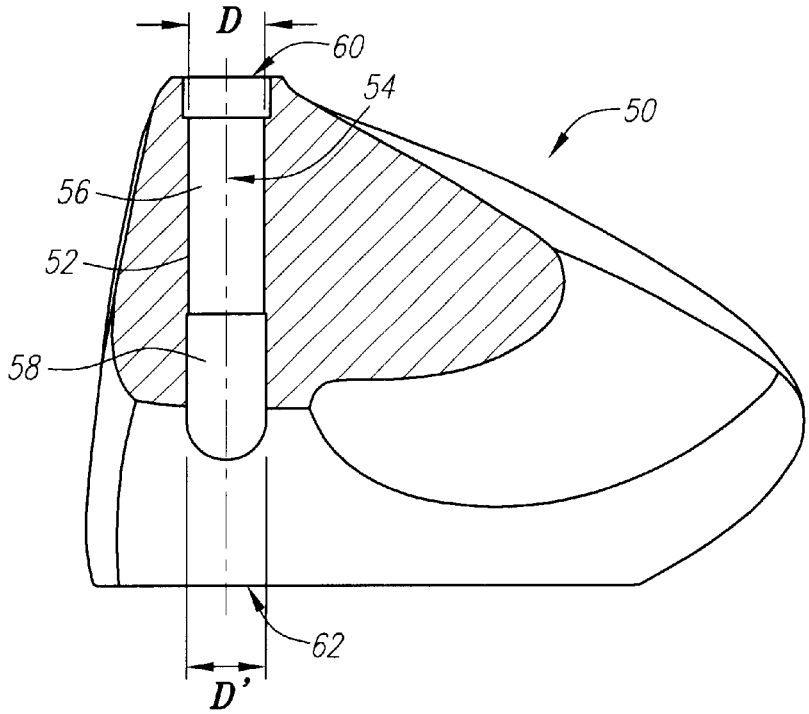
FIG. 5A is a cross-sectional view of the wood-type golf club head of FIG. 5 along line A—A.
Figure 6:
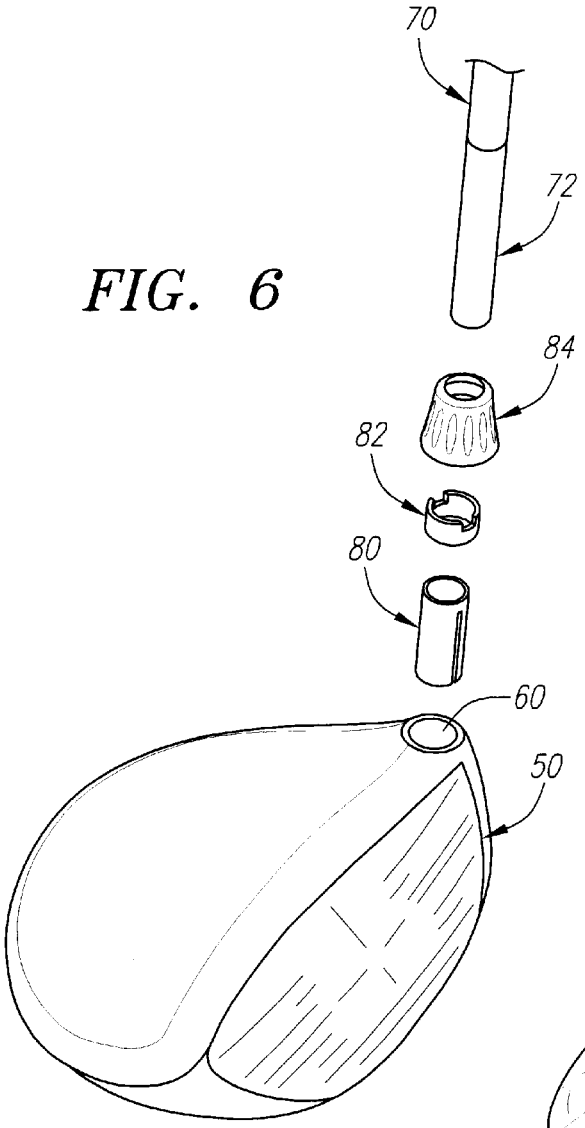
FIG. 6 is an exploded view of a wood-type golf club.

Referring to FIGS. 5, 5A and 6, a wood-type golf club head 50 has a hosel 52 with a tapered bore 54. The tapered bore 54 has an upper portion 56 and a lower portion 58, wherein the diameter of the bore 54 tapers from the upper portion 56 to the lower portion 58. In a preferred embodiment, the upper portion 56 has a diameter D that ranges from 0.25 inch to 0.625 inch, and the lower portion 58 has a diameter D' that ranges from 0.25 inch to 0.50 inch, with the upper portion diameter D being greater than the lower portion diameter D' such that the upper portion 56 of the tapered bore 54 preferably has about a 1° taper on each side, or about a 2° included taper. The golf club head 50 preferably has an interior hosel 52, however, those skilled in the pertinent art will recognize that external hosel golf club heads are well within the scope and spirit of the present invention. One example of a golf club head 50 with an interior hosel is the STEELHEAD PLUS® driver available from the Callaway Golf Company of Carlsbad, Calif. With a golf club head 50 with an interior hosel 52, the golf club head 50 preferably has a crown opening 60 and a sole opening 62 for accessing the tapered bore 54. In a preferred embodiment of the invention, the upper portion 56 of the tapered bore 54 of the hosel 52 has a threaded portion (not shown) for receiving a retention nut, as described below.

A shaft 70 has a tip end 72, which is inserted into the hosel 52 of the golf club head 50. The shaft 70 may be composed of a stainless steel or a graphite material. A ferrule 84, a retention nut 82 and a sleeve 80 are placed over the tip end 72 of the shaft 70. The sleeve 80 is then inserted with the tip end 72 of the shaft 70 into the tapered bore 54 as described below. The retention nut 82 is then threaded into the hosel 52, and the ferrule 84 threaded onto the retention nut 82, as described below.

Figure 3:
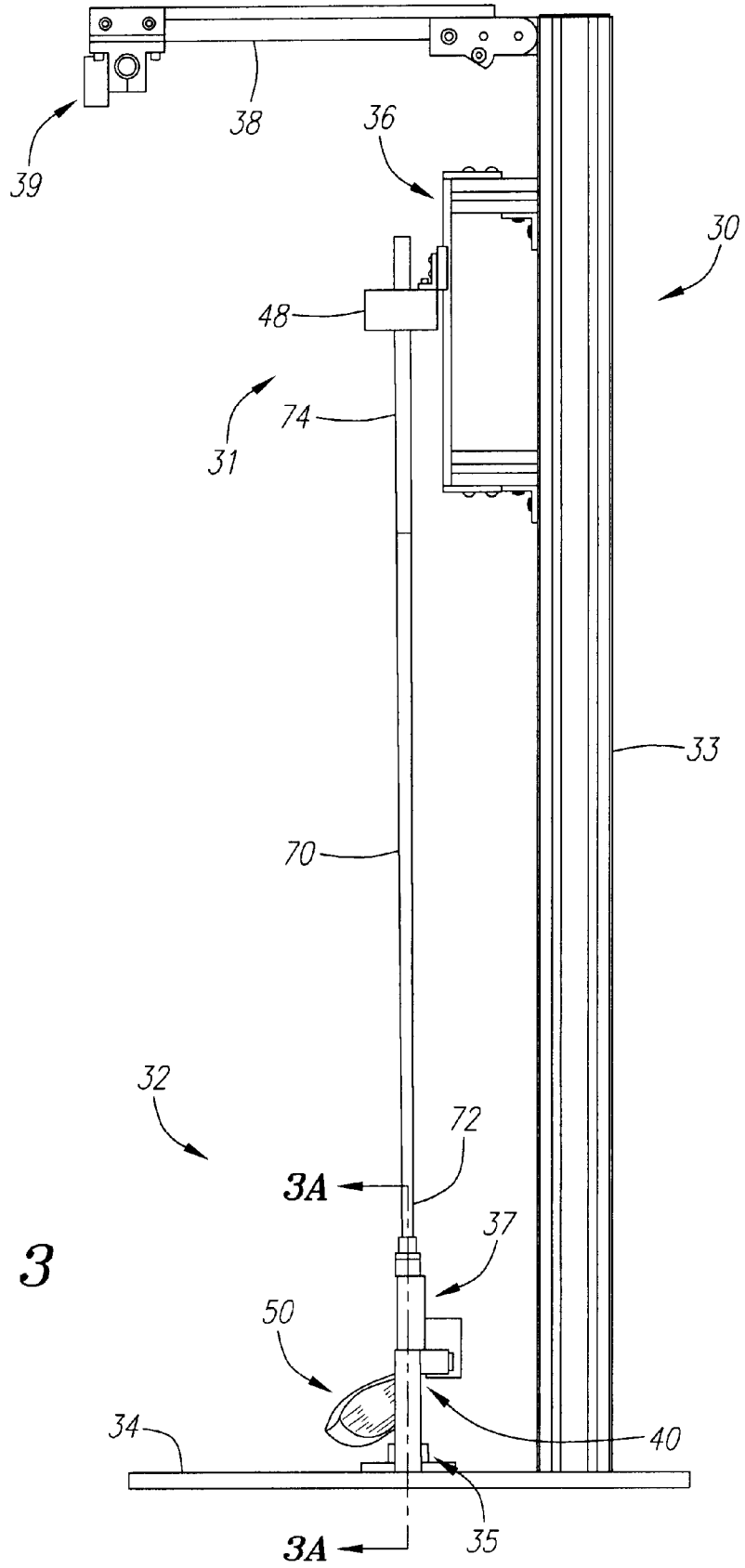
FIG. 3 is a side view of the apparatus of FIG. 1 with a golf club head and shaft in a pre-pressing position.
Figure 3A:
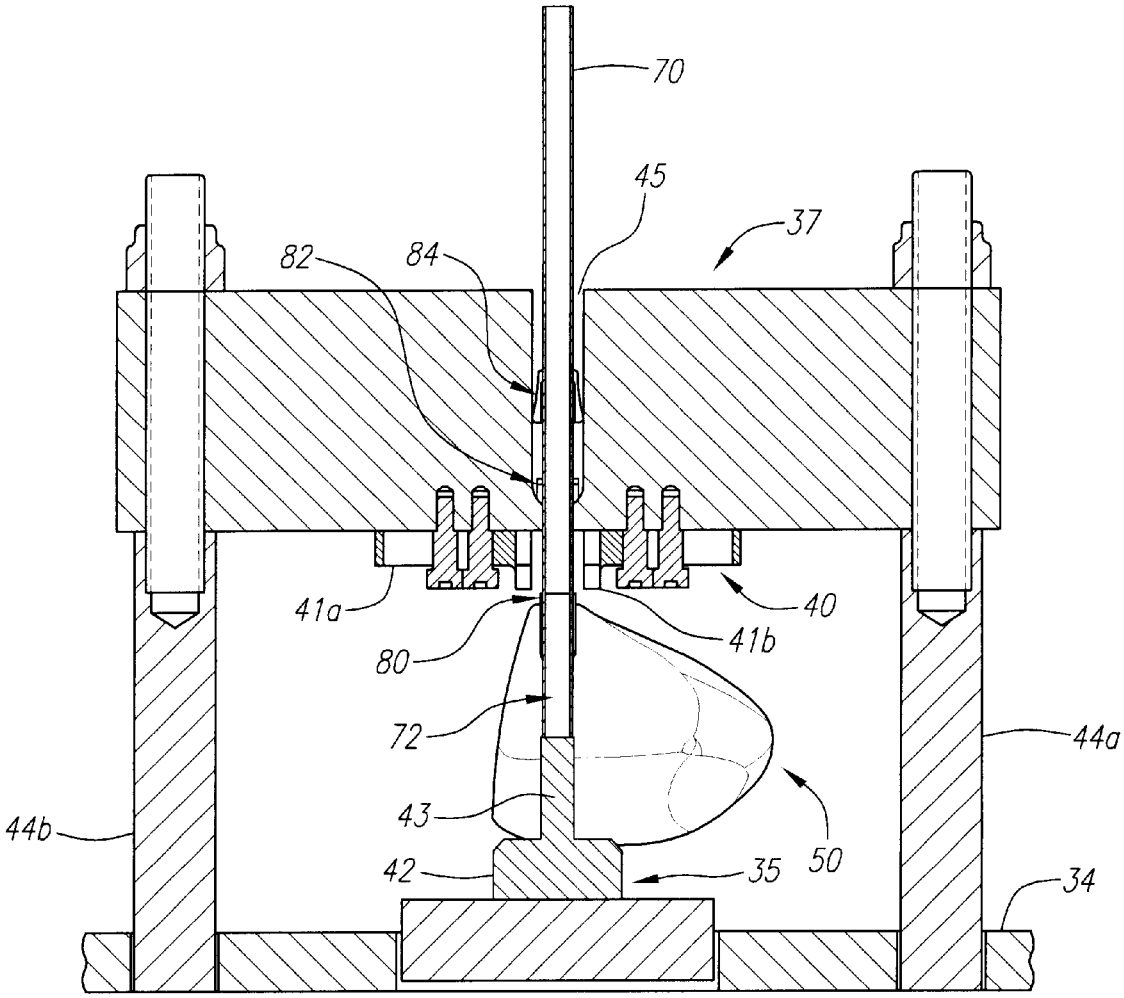
FIG. 3A is an enlarged cross-sectional view FIG. 3 along line A—A.

Referring now to FIGS. 3 and 3A, the golf club head 50 is positioned on the golf club head alignment device 35 by placing the hosel 52 over the projection 43. Next, the shaft 70, with the ferrule 84, retention nut 82 and sleeve 80 placed over the tip end 72, is positioned within the holding device 36 by inserting a butt end 74 of the shaft 70 into the aperture (not shown) of the retaining member 48. The holding device 36 is then moved along the elongated bar 33 away from the the golf club head alsignment device 35. Those of ordinary skill in the art will recognize that although the assembly apparatus 30 is illustrated in a vertical orientation, other orientations, such as horizontal, may also be used.

Figure 4:
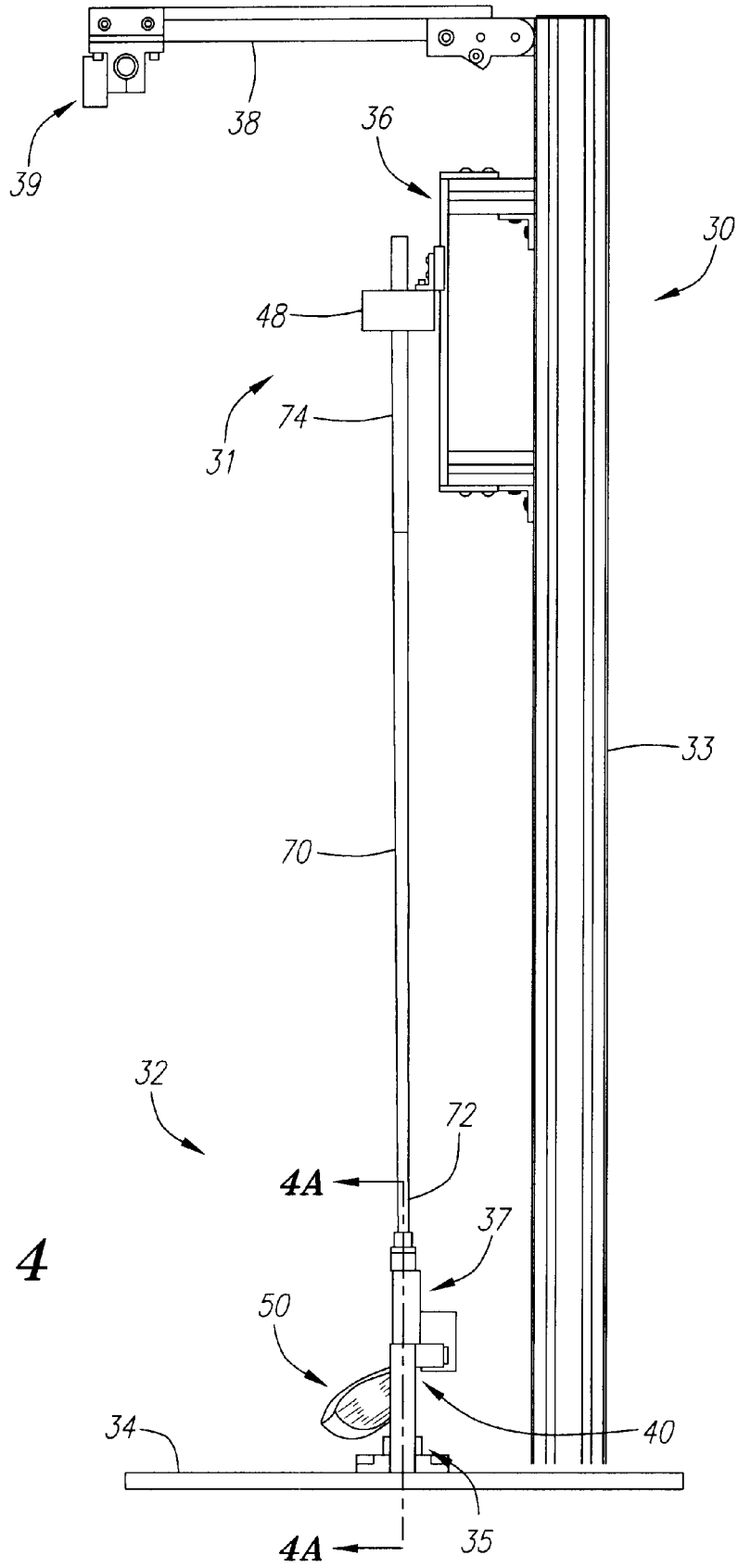
FIG. 4 is a side view of the apparatus of FIG. 1 with a golf club head and shaft in a post-pressing position.
Figure 4A:
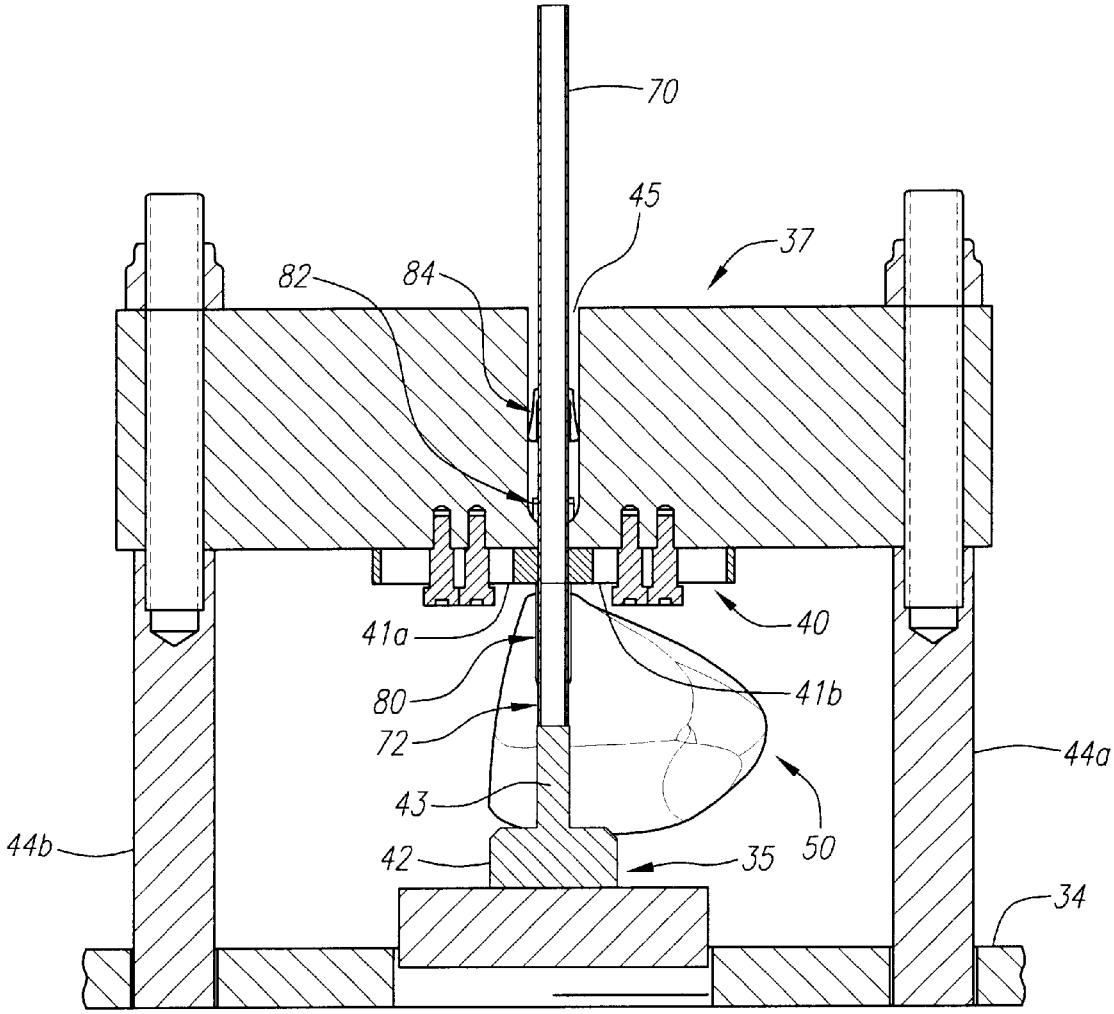
FIG. 4A is an enlarged cross-sectional view FIG. 4 along line A—A.

Next, a portion of the shaft 70 with the ferrule 84 and the retention nut 82 are placed within the cavity 45 of the press device 37. The sleeve 80 and the tip portion 72 of the shaft 70 are then inserted into the tapered bore 54 of the hosel 52 of the golf club head 50, which is positioned in the golf club head alignment device 35. A portion of the sleeve 80 extends above the crown opening 60 of the golf club head 50. Next, the jaws 41*a* and 41*b* of the jaw mechanism 40 enclose about a portion of the shaft 70 below the retention nut 82 and above the sleeve 80. In a preferred embodiment of the invention, the jaws 41*a* and 41*b* do not engage the shaft. Preferably, the bottom of each of the jaws 41*a* and 41*b* engages the top surface of the sleeve 80. Next, the press device 37 moves toward the golf club head 50 to force the sleeve 80 further into the tapered bore 54 as shown in FIGS. 4 and 4A. Approximately 3800 pounds of force are used to insert the sleeve 80 in the tapered bore 54. The press travels between approximately 0.25 inch and 1.00 inch toward the club head alignment device 35. The decreasing diameter of the tapered bore 54 collapses the sleeve 80 around the shaft 70, thereby retaining the shaft 70 within the tapered bore 54 of the hosel 52 of the golf club head 50 without the use of an epoxy or other adhesive.

Figure 7:
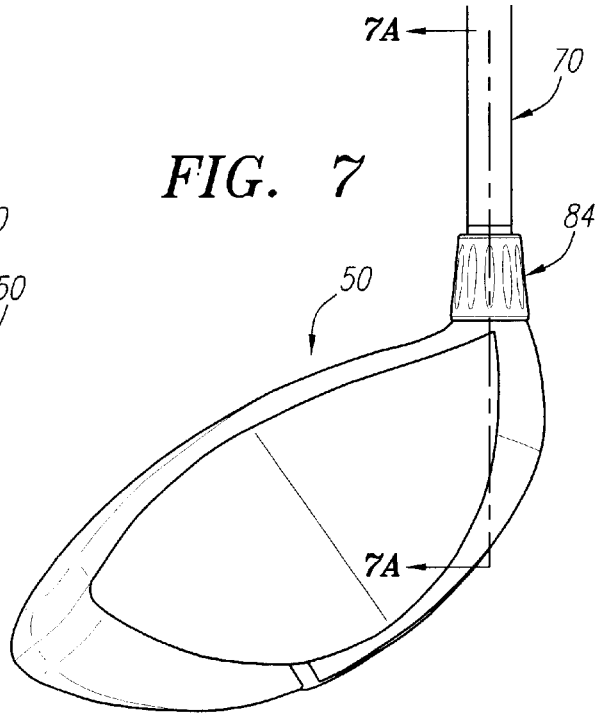
FIG. 7 is a front view of a wood-type golf club.
Figure 7A:
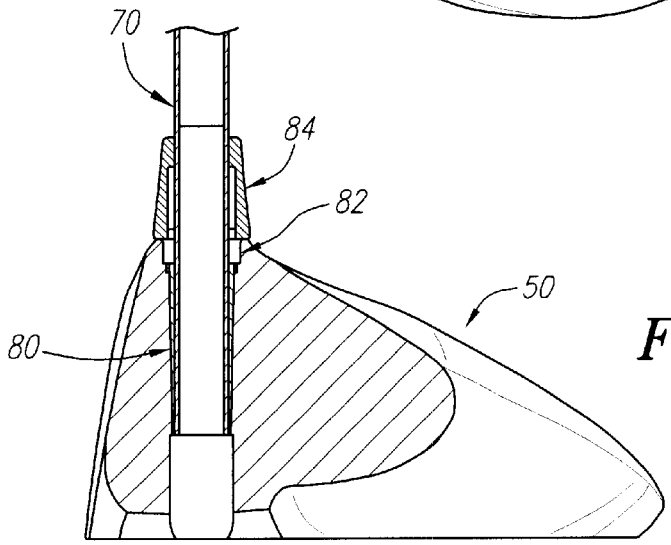
FIG. 7A is a cross-sectional view of the wood-type golf club head of FIG. 7 along line E—E.

The golf club head 50 with the partially attached shaft 70 is then removed from the apparatus 30. Next, the retention nut 82 is threaded into the hosel 52 to provide an additional means of securing the sleeve 80 within the tapered bore 54. The ferrule 84 may then be threaded onto the retention nut 82 or the hosel 52 to completely attach the shaft 70 to the golf club head 50. FIGS. 7 and 7A illustrate the golf club head 50 with the shaft 70 completely attached. Those of ordinary skill in the art will appreciate that the retention nut 82 is an optional element, providing additional assurance that the sleeve is secured in the tapered bore 54. If a retention nut is not used, then the ferrule 84 is secured within the tapered bore 54 of the hosel 52.

Figure 8:
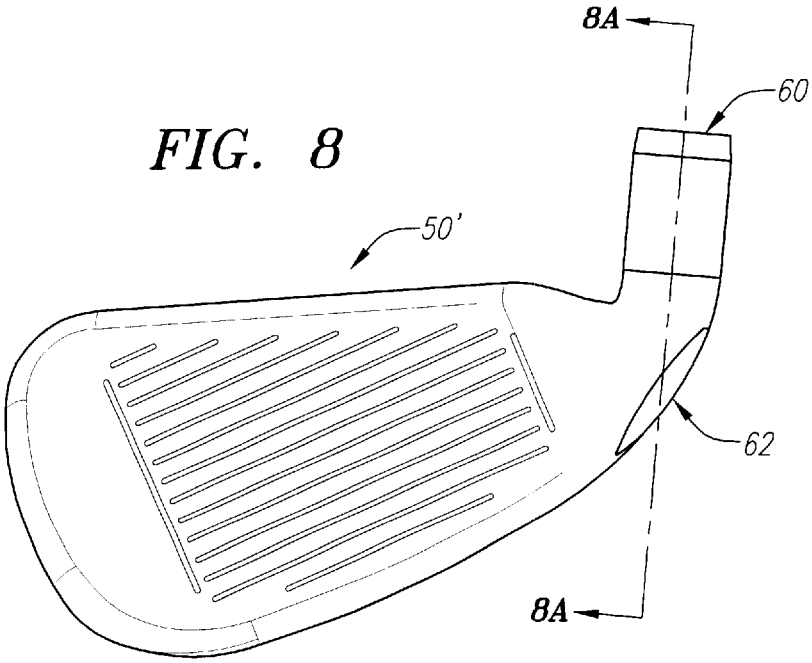
FIG. 8 is an isolated view of an iron-type golf club head.
Figure 8A:
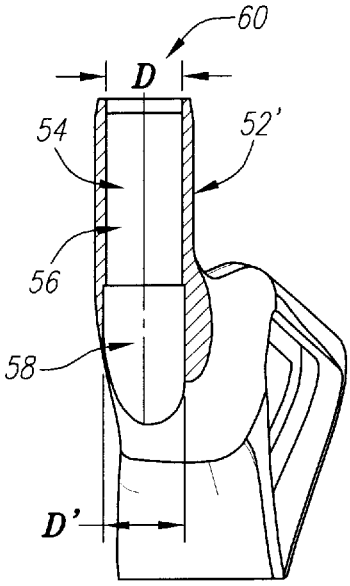
FIG. 8A is a cross-sectional view of the iron-type golf club head of FIG. 8 along line A—A.
Figure 9:
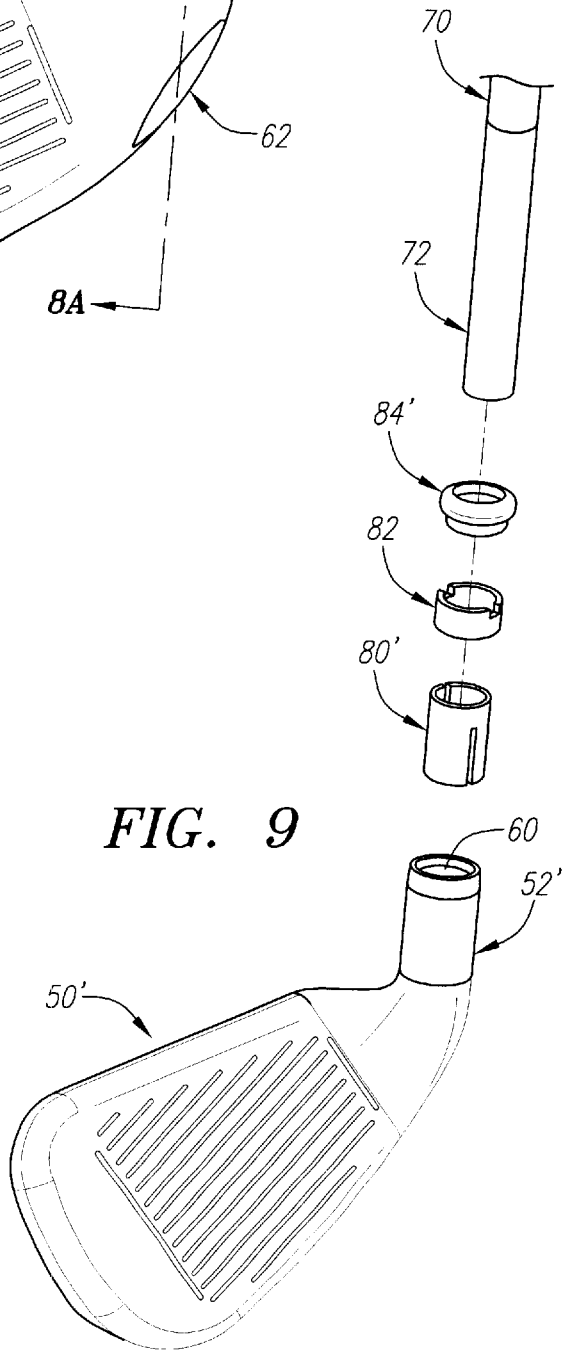
FIG. 9 is an exploded view of an iron-type golf club.

The assembly apparatus 30 may also be used to attach a shaft to an iron-type golf club head. Referring to FIGS. 8, 8A and 9, an iron-type golf club head 50' has a hosel 52' with a tapered bore 54. The tapered bore 54 has an upper portion 56 and a lower portion 58, wherein the diameter of the bore 54 tapers from the upper portion 56 to the lower portion 58. In a preferred embodiment, the upper portion 56 has a diameter D that ranges from 0.25 inch to 0.625 inch, and the lower portion 58 has a diameter D' that ranges from 0.25 inch to 0.50 inch, with the upper portion diameter D being greater than the lower portion diameter D' such that the upper portion 56 of the tapered bore 54 preferably has about a 1° taper on each side, or about a 2° included taper. One example of a golf club head 50' is the STEELHEAD® X-14® iron available from the Callaway Golf Company of Carlsbad, Calif. The golf club head 50' preferably has a crown opening 60 and a sole opening 62 for accessing the tapered bore 54. The upper portion 56 of the tapered bore 54 of the hosel 52' has a threaded portion (not shown) for receiving a retention nut, as described below.

A shaft 70 has a tip end 72, which is inserted into the hosel 52' of the golf club head 50'. A ferrule 84', a retention nut 82 and a sleeve 80' are placed over the tip end 72 of the shaft 70'. The sleeve 80' is then inserted with the tip end 72 of the shaft 70' into the tapered bore 54 in the same manner as described above with respect to the wood-type golf club head 50.

Figure 10:
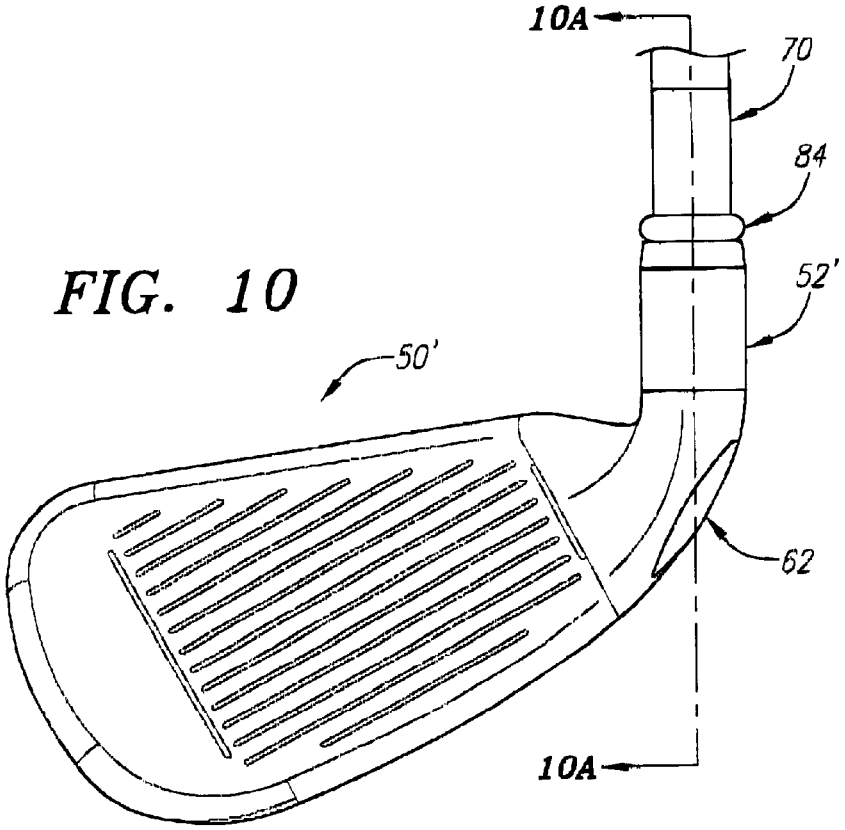
FIG. 10 is a front view of an iron-type golf club.
Figure 10A:
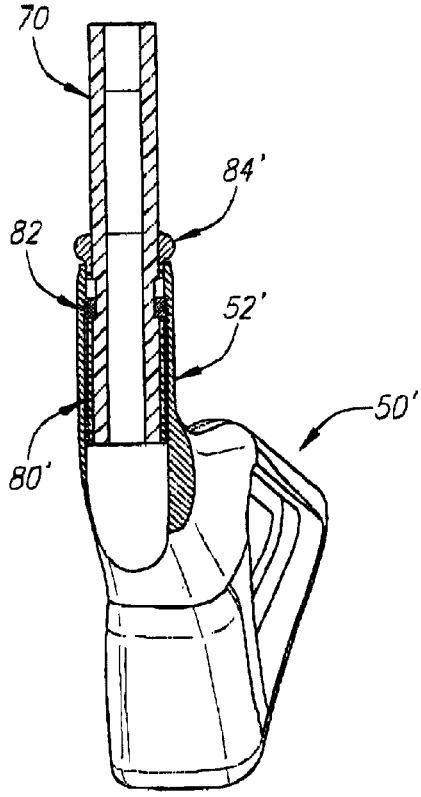
FIG. 10A is a cross-sectional view of the iron-type golf club head of FIG. 10 along line A—A.
Figure 14:
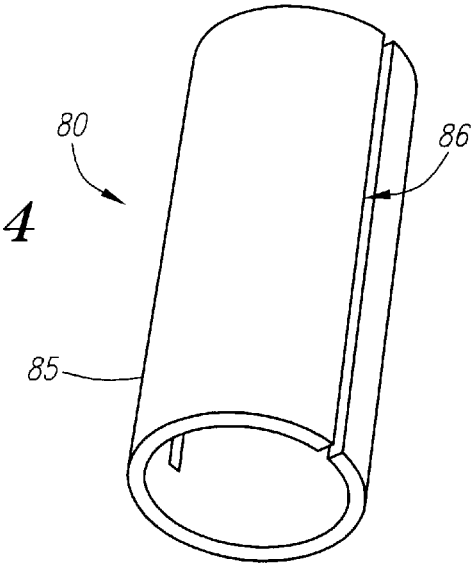
FIG. 14 is an isolated perspective view of a sleeve for use with a wood-type golf club head.
Figure 15:
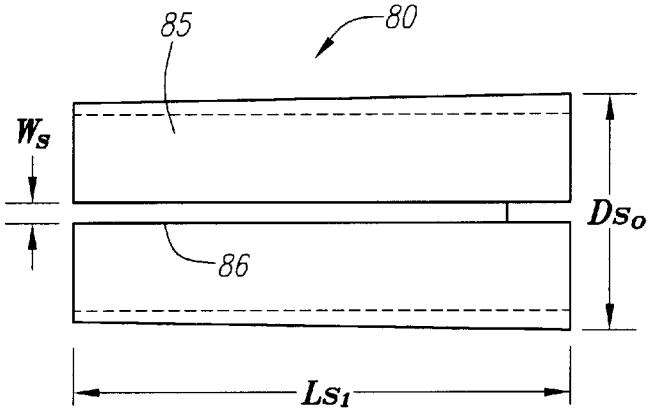
FIG. 15 is a side view of the sleeve of FIG. 14.
Figure 16:
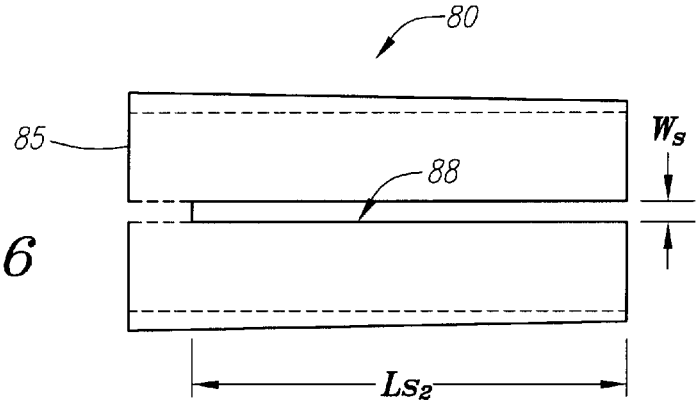
FIG. 16 is an opposite side view of the sleeve of FIG. 15.
Figure 17:
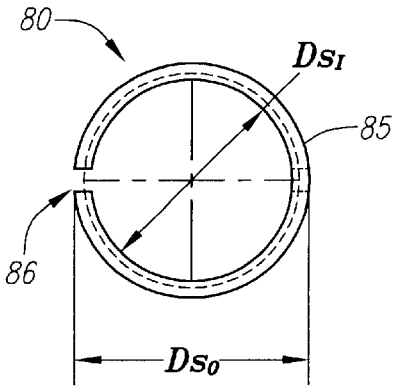
FIG. 17 is a top plan view of the sleeve of FIG. 14.
Figure 18:
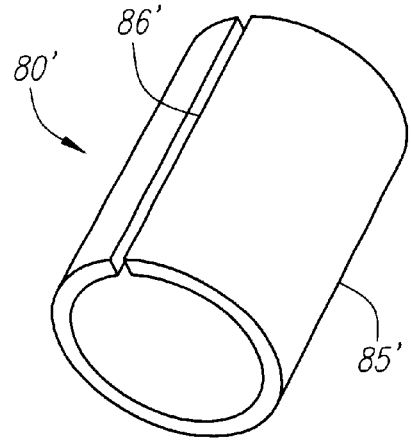
FIG. 18 is an isolated perspective view of a sleeve for use with an iron-type golf club head.
Figure 19:
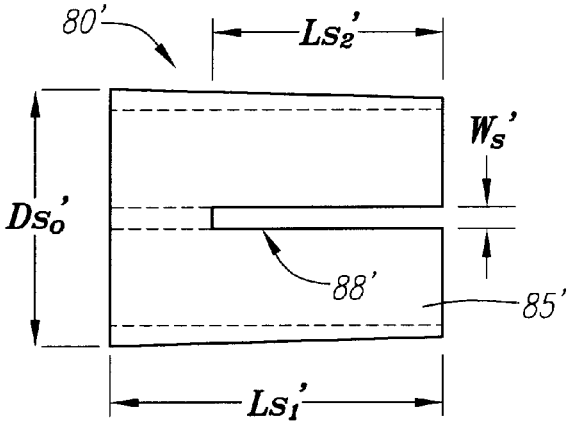
FIG. 19 is a side view of the sleeve of FIG. 18.
Figure 20:
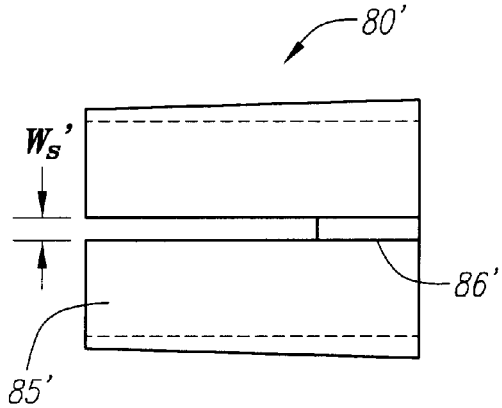
FIG. 20 is an opposite side view of the sleeve of FIG. 19.
Figure 21:
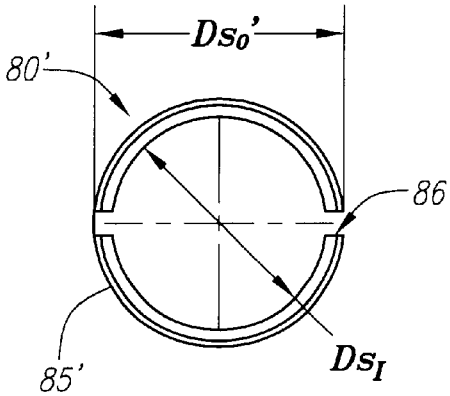
FIG. 21 is a top plan view of the sleeve of FIG. 18.

After the assembly apparatus 30 has been used to partially attach the shaft 70' to the golf club head 50', the golf club head 50' with the partially attached shaft 70' is removed. The retention nut 82 is then threaded into the hosel 52', and the ferrule 84' is secured to either the retention nut 82 or the hosel 52'. As discussed above with respect to the wood-type golf club head 50, the retention nut 82 may be omitted. FIGS. 10 and 10A illustrate the golf club head 50' with the shaft 70 completely attached.

The present invention provides a golf club with a shaft securely attached to the club head without the use of epoxy. A pull test was performed on several golf clubs assembled in accordance with the present apparatus and method. For this test, the shaft of each golf club is cut between 4 inches and 5 inches above the club head, and a pin is inserted into the shaft. The golf club head is then mounted in a fixture to prevent movement of the club head during the test. First and second clamps are respectively fastened to the pin and the lower end of the shaft proximate the club head. The first clamp is coupled to a transducer, which measures the force required to remove the shaft from the head. The golf clubs of the present invention all recorded a pull force of greater than 2000 lbs. to remove the shaft from the club head. The present invention preferably produces golf clubs with a pull force of within the range of 2000 lbs. and 4000 lbs.

FIGS. 11–13 illustrate the retention nut 82 in greater detail. The retention nut 82 includes a cylindrical body 92. The cylindrical body 92 has a length Lr that ranges preferably from 0.15 inch to 0.30 inch, more preferably from 0.18 inch to 0.25 inch, and most preferably approximately 0.21 inch. The cylindrical body 92 may have an outer diameter Dr preferably between 0.4 inch and 0.55 inch, and more preferably approximately 0.47 inch, and an inner diameter D'r preferably between 0.30 inch and 0.45 inch, and more preferably approximately 0.37 inch. The retention nut 82 has an external thread 93 for engaging the threaded portion of the upper portion 56 of the tapered bore 54. Diametrically opposed notches 94*a* and 94*b* are formed in the cylindrical body 92 at one end and are designed to receive a tool, such as a spanner wrench, for installing the retention nut 82. Notches 94*a* and 94*b* may have a width Wn of approximately 0.125 inch and a depth Dn of approximately 0.060 inch.

FIGS. 14–17 illustrate the sleeve 80 for use with the wood-type golf club head 50 in greater detail. The sleeve 80 includes a generally cylindrical body 85 having a length $Ls_1$ preferably between 0.50 inch and 2.0 inches, more preferably between 0.70 inch and 1.0 inch, and most preferably approximately 0.860 inch. The cylindrical body 85 of sleeve 80 preferably has an included taper of approximately 2°, with about a 1° taper on each side. The tapered cylindrical body 85 preferably has an outer diameter $Ds_0$ at its widest end of preferably between 0.35 inch and 0.50 inch, and more preferably approximately 0.407 inch, and an inner diameter $Ds_1$ of preferably between 0.25 inch and 0.40, and more preferably approximately 0.348 inch. The sleeve 80 has a first slit 86 and a second slit 88 that enable sleeve 80 to close around the shaft 70 within the hosel 52. Those of ordinary skill in the art will appreciate that any number of slits may be used. The first slit 86 extends along the entire length $Ls_1$ of the cylindrical body 85, while the second slit 88 extends along the majority of the length $Ls_1$. The second slit 88 has a length $Ls_2$ of preferably between 0.60 inch to 0.85 inch, and more preferably about 0.752 inch. Each of the first and second slits 86 and 88 has a width Ws of preferably between 0.02 inch and 0.06 inch, and more preferably approximately 0.03 inch. The sleeve 80 is preferably composed of a metal material, such as aluminum, stainless steel, or titanium, but, alternatively, may be composed of a plastic material, such as a polyamide.

FIGS. 18–21 illustrate the sleeve 80' for use with the iron-type golf club head 50' in greater detail. The sleeve 80' includes a generally cylindrical body 85' having a length $L's_1$ preferably between 0.30 inch and 1.5 inches, more preferably between 0.50 inch and 1.0 inch, and most preferably approximately 0.60 inch. The cylindrical body 85' of sleeve 80' preferably has an included taper of approximately 2°, with about a 1° taper on each side. The tapered cylindrical body 85' preferably has an outer diameter $D's_0$ at its widest end of preferably between 0.375 inch and 0.55 inch, and more preferably approximately 0.455 inch, and an inner diameter $D's_1$ of preferably between 0.27 inch and 0.45 inch, and more preferably approximately 0.375 inch. The sleeve 80' has a first slit 86' and a second slit 88' that enable sleeve 80' to close around the shaft 70 within the hosel 52'. Alternatively, a single slit or more than two slits may also be used. The first slit 86' extends along the entire length $L's_1$ of the cylindrical body 85', while the second slit 88' extends along the majority of the length $L's_1$. The second slit 88 has a length $L's_2$ of preferably between 0.30 inch and 0.50 inch, and more preferably about 0.417 inch. Each of the first and second slits 86' and 88' has a width W's of preferably between 0.02 inch and 0.06 inch, and more preferably approximately 0.03 inch. Like sleeve 80, sleeve 80' is preferably composed of a metal material, such as aluminum, stainless steel, or titanium, but, alternatively, may be composed of a plastic material, such as a polyamide.

Figure 22:
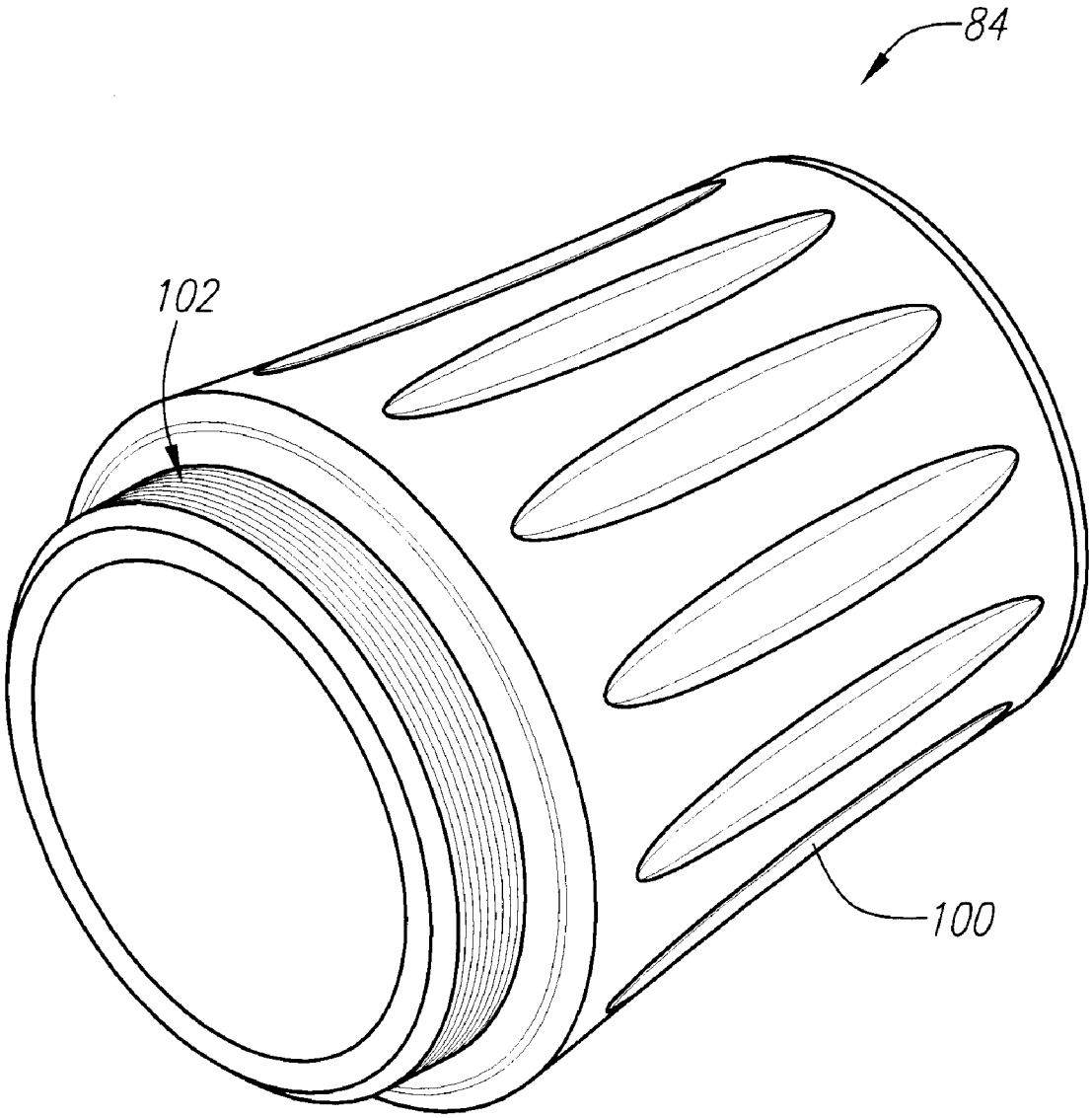
FIG. 22 is a perspective view of a ferrule for use with a wood-type golf club head.

FIG. 22 illustrates the ferrule 84 for use with the wood-type golf club head 50 in greater detail. The ferrule 84 provides added support to the shaft 70 during a golf swing. The ferrule 84 includes a body 100 having a threaded portion 102 for engagement with the retention nut 82. Although not illustrated, the ferrule 84' for use with the iron-type golf club head 50' also a threaded portion for engagement with the retention nut 82.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. For example, the orientation of the assembly apparatus 30 need not be vertical, but may also be horizontal. In addition, the press device 37 is not required to have a cavity. Therefore, the embodiments of the invention in which an exclusive property or privilege is claimed are defined in the following appended claims.

We claim as our invention:

1. A golf club comprising:

a golf club head including a hosel having a tapered bore;

a shaft having a tip end inserted into the tapered bore of the hosel;

a tapered sleeve disposed on the tip end of the shaft in the tapered bore of the hosel, the sleeve composed of a metal, and the sleeve having at least one slit; and a retention nut disposed on the shaft between the sleeve and a ferrule, and the retention nut secured in the tapered bore.

2. The golf club according to claim 1, wherein the golf club head is a wood-type golf club head.

3. The golf club head according to claim 2, wherein the hosel is an interior hosel having a crown opening and a sole opening.

4. The golf club head according to claim 1, wherein the golf club head is an iron-type golf club head.

5. The golf club head according to claim 1, wherein the ferrule has a threaded portion for engagement with the hosel.

6. The golf club according to claim 1, wherein the sleeve has a length ranging from 0.5 inch to 2.0 inches.

7. The golf club according to claim 1, wherein the shaft is composed of a graphite material.

8. The golf club according to claim 1, wherein the shaft is composed of a stainless steel material.

9. The golf club according to claim 1, wherein the ferrule is coupled to the retention nut.

* * * * *